US010319328B2

(12) United States Patent
Kim et al.

(10) Patent No.: US 10,319,328 B2
(45) Date of Patent: Jun. 11, 2019

(54) DISPLAY DEVICE AND METHOD OF DRIVING THE SAME

(71) Applicant: SAMSUNG DISPLAY CO., LTD., Yongin-si, Gyeonggi-Do (KR)

(72) Inventors: Kyun Ho Kim, Hwaseong-si (KR); Bong Gyun Kang, Suwon-si (KR); Sang An Kwon, Cheonan-si (KR); Seung Hwan Moon, Asan-si (KR); Yong Jin Shin, Asan-si (KR); Neung Beom Lee, Hwaseong-si (KR); Jun Pyo Lee, Asan-si (KR); Kyung Hwa Lim, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 24 days.

(21) Appl. No.: 15/800,773

(22) Filed: Nov. 1, 2017

(65) Prior Publication Data

US 2018/0301105 A1 Oct. 18, 2018

(30) Foreign Application Priority Data

Apr. 14, 2017 (KR) ..... 10-2017-0048336

(51) Int. Cl.
*G09G 3/20* (2006.01)
*G09G 3/36* (2006.01)

(52) U.S. Cl.
CPC ..... *G09G 3/3685* (2013.01); *G09G 3/2003* (2013.01); *G09G 2310/027* (2013.01); *G09G 2310/08* (2013.01); *G09G 2320/0242* (2013.01); *G09G 2330/045* (2013.01)

(58) Field of Classification Search
None
See application file for complete search history.

(56) References Cited

FOREIGN PATENT DOCUMENTS

KR 10-1243144 3/2013
KR 10-2015-0073545 7/2015

*Primary Examiner* — Nicholas J Lee
(74) *Attorney, Agent, or Firm* — F. Chau & Associates, LLC

(57) ABSTRACT

A display device and method is provided that permits selection of a first lookup table or a second lookup table to operate the data driver at respectively different temperatures to prevent heat from damaging the display device. The display device includes a detector which detects the number of toggles in which the amount of change in gray values of successive pixels driven by the same data line in one frame is equal to or greater than a reference gray change amount. A comparator compares the number of toggles detected by the detector with a reference number of toggles, and a lookup table selector which selects any one of a first lookup table and a second lookup table based on the comparison result of the comparator and provides the selected first lookup table or second lookup table to a data driver.

23 Claims, 17 Drawing Sheets

FIG.6

| | B | G | R |
|---|---|---|---|
| 0 | 5 | 5 | 5 |
| 1 | 6 | 6 | 6 |
| 2 | 8 | 8 | 8 |
| 3 | 10 | 10 | 10 |
| | | | |
| | | | |
| 239 | 240 | 240 | 240 |
| 240 | 241 | 241 | 241 |
| 241 | 241 | 241 | 241 |
| 242 | 242 | 242 | 242 |
| 243 | 242 | 242 | 242 |
| 244 | 242 | 243 | 243 |
| 243 | 242 | 244 | 244 |
| 245 | 242 | 245 | 245 |
| 246 | 243 | 246 | 246 |
| 247 | 243 | 247 | 247 |
| 248 | 243 | 248 | 248 |
| 249 | 243 | 250 | 250 |
| 250 | 244 | 251 | 251 |
| 251 | 244 | 252 | 252 |
| 252 | 244 | 253 | 253 |
| 253 | 245 | 254 | 254 |
| 254 | 245 | 255 | 255 |
| 255 | 245 | 255 | 255 |

FIG.8

| | B | G | R |
|---|---|---|---|
| 0 | 5 | 5 | 5 |
| 1 | 6 | 6 | 6 |
| 2 | 8 | 8 | 8 |
| 3 | 10 | 10 | 10 |
| | | | |
| | | | |
| 239 | 240 | 240 | 240 |
| 240 | 241 | 241 | 241 |
| 241 | 241 | 241 | 241 |
| 242 | 242 | 242 | 242 |
| 243 | 242 | 242 | 242 |
| 244 | 243 | 243 | 243 |
| 243 | 244 | 244 | 244 |
| 245 | 245 | 245 | 245 |
| 246 | 246 | 246 | 246 |
| 247 | 247 | 247 | 247 |
| 248 | 248 | 248 | 248 |
| 249 | 250 | 250 | 250 |
| 250 | 251 | 251 | 251 |
| 251 | 252 | 252 | 252 |
| 252 | 253 | 253 | 253 |
| 253 | 254 | 254 | 254 |
| 254 | 255 | 255 | 255 |
| 255 | 255 | 255 | 255 |

DISPLAY DEVICE AND METHOD OF DRIVING THE SAME

This application claims the benefit of priority from Korean Patent Application No. 10-2017-0048336, filed on Apr. 14, 2017, in the Korean intellectual Property Office, the disclosure of which is incorporated herein by reference in its entirety.

TECHNICAL FIELD

The present inventive concept relates to a display device and a method of driving the same.

Discussion of the Related Art

Display devices such as a liquid crystal display (LCD) and an organic light emitting diode display (OLED) have become popular and continue to be actively developed.

An LCD obtains a desired image by applying an electric field to a liquid crystal layer interposed between two display panels and adjusting the intensity of the electric field to control the transmittance of light passing through the liquid crystal layer. An OLED displays characters or images using electroluminescence of specific organic materials or polymers.

With regard to such display devices, an LCD includes an image display unit having pixels including switching elements and a pixel driving unit having various circuits and integrated circuits for generating signals used for driving each pixel included in the image display unit.

The pixel driving unit includes a scan driver which provides a scan signal to each pixel, a data driver which provides a data voltage to each pixel, a gamma voltage generator which provides a voltage to the data driver, and a signal controller which controls the scan driver, the data driver and the gamma voltage generator.

The data driver converts digital image data that is received from the signal controller in a digital format into an analog data signal in an analog format based on a gray voltage output from the gamma voltage generator, and provides the analog data signal to the image display unit.

The data driver is composed of a plurality of data driving chips. Each data driving chip is connected to a predetermined number of data lines to provide data signals to the data lines. Accordingly, as the number of data lines increases, the number of data driving chips that are used to provide data signals increases.

However, since the manufacturing cost of the data driver composed of data driving chips is relatively higher than the costs of manufacturing a scan driver, (even if the number of scan lines that receive scan signals from the scan driver increases), the number of data lines that receive data signals from the data driver is designed to be minimized.

However, as the number of pixels controlled by one data line increases, the frequency of change of data signals provided to the data lines also increases sharply, which may cause the data driving chips to overheat and be damaged. In other words, the data driver may overheat and be damaged.

Accordingly, there is a need in art to design a display device that can prevent overheating of the data driver while increasing the number of pixels controlled by one data line, and a method of driving the display device.

SUMMARY

The inventive concept provides a display device having a structure which can prevent overheating of a data driver.

The inventive concept also provides a method of driving a display device which can prevent overheating of a data driver.

However, the inventive concept is not limited to the embodiments shown and described herein. The inventive concept will become more apparent to one of ordinary skill in the art to which the inventive concept pertains by referencing the detailed description of the inventive concept given below.

According to the inventive concept, there is provided a display device. The display device comprises a detector which calculates (detects) the number of toggles in which the amount of change in gray values of successive pixels driven by the same data line in one frame is equal to or greater than a reference gray change amount, a comparator which compares the number of toggles detected by the detector with a reference number of toggles, and a lookup table selector which selects any one of a first lookup table and a second lookup table based on the comparison result of the comparator and provides the selected first lookup table or second lookup table to a data driver.

According to the inventive concept, there is provided a display device. The display device comprises a detector which detects the number of toggles in which the amount of change in gray values of successive pixels driven by the same data line in one frame is equal to or greater than a reference gray change amount, a comparator which compares the number of toggles detected by the detector with a reference number of toggles, and a driving voltage converter which controls a data driver to be driven using any one of a first driving voltage and a second driving voltage based on the comparison result of the comparator.

BRIEF DESCRIPTION OF THE DRAWINGS

The inventive concept will become better appreciated by a person of ordinary skill in the art from the following description of the embodiments, taken in conjunction with the accompanying drawings in which:

FIG. 6 illustrates the first lookup table;

FIG. 8 illustrates the second lookup table;

DETAILED DESCRIPTION

Figure 1:
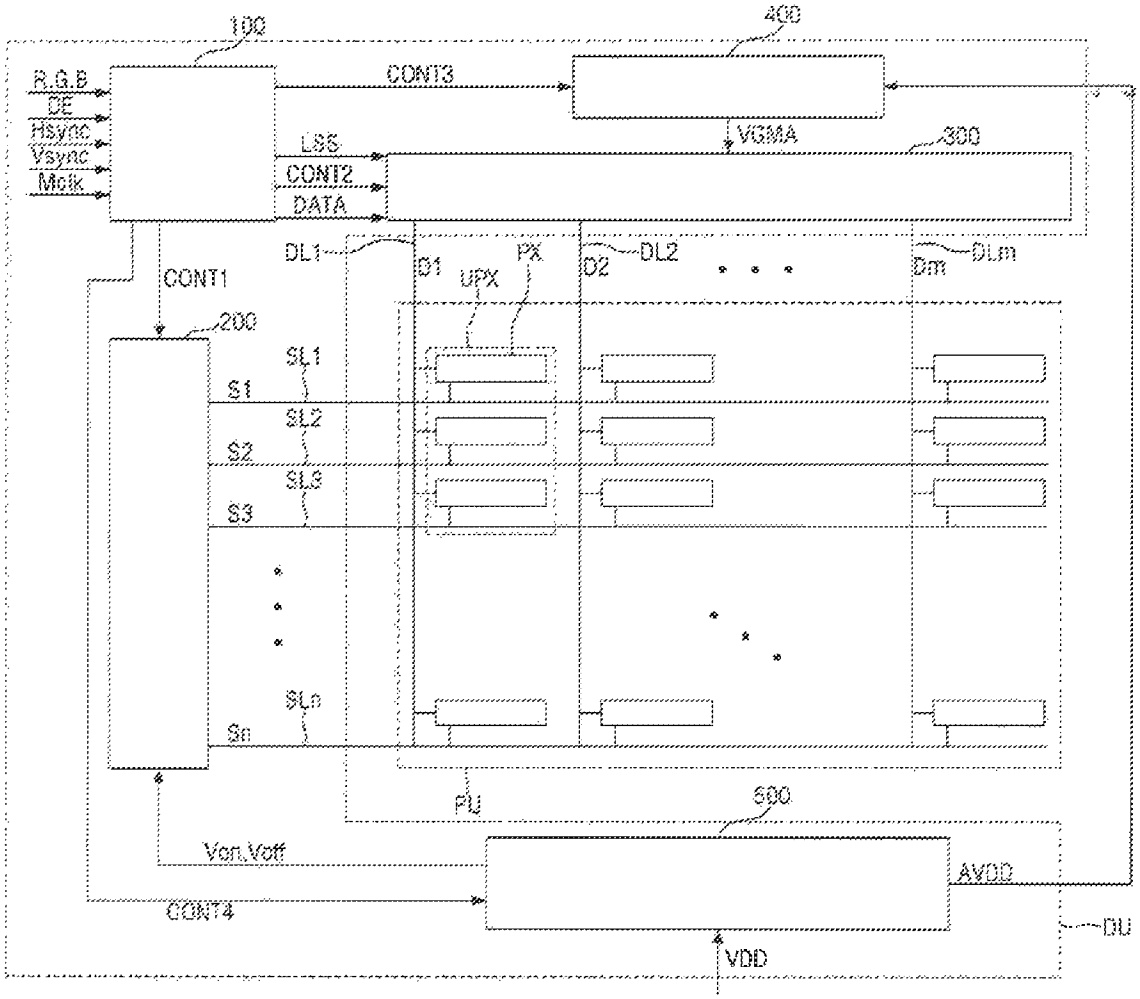
FIG. 1 is a block diagram of a liquid crystal display (LCD) according to an embodiment of the inventive concept.

The present inventive concept will now be described more fully hereinafter with reference to the accompanying drawings, in which embodiments of the inventive concept are shown. This inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art. The same reference numbers indicate the same components throughout the specification. In the attached figures, the thickness of layers and regions is exaggerated for clarity.

It will be understood by persons of ordinary skill in the art that, although the terms first, second, third, etc., may be used herein to describe various elements, these elements are not be limited by these terms. These terms are only used to distinguish one element from another element. Thus, a first element discussed below could be termed a second element without departing from the teachings of the inventive concept.

The terminology used herein is for the purpose of describing particular embodiments only and is the inventive concept is limited thereby. As used herein, the singular forms "a,", "an" and "the" are intended to include the plural forms, including "at least one", unless the content clearly indicates otherwise. "Or" means "and/or." As used herein, the term "and/or" includes any and all combinations of one or more of the associated listed items. It will be further understood by persons of ordinary skill in the art that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood by persons of ordinary skill in the art that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

In the present inventive concept, an electronic apparatus may be any apparatus provided with a display device. Examples of the electronic apparatus may include but are not limited to smart phones, mobile phones, navigators, game machines, TVs, car head units, notebook computers, laptop computers, tablet computers, personal media players (PMPs), and personal digital assistants (PDAs). The electronic apparatus may be embodied as a pocket-sized portable communication terminal having a wireless communication function. Further, the display device may be a flexible display device capable of changing its shape.

Hereinafter, embodiments of the present inventive concept will now be described with reference to the attached drawings.

FIG. 1 is a block diagram of an LCD according to an embodiment of the inventive concept.

Referring now to FIG. 1, the LCD according to the embodiment includes an image display unit PU and a pixel driving unit DU.

The image display unit PU includes a plurality of scan lines SL1 through SLn, a plurality of data lines DL1 through DLm, and a plurality of pixels PX. The pixels PX are connected to the scan lines SL1 through SLu and the data lines DL1 through DLm and are arranged in a substantially matrix form. The scan lines SL1 through SLn extend substantially in a row direction so as to be substantially parallel to each other. The data lines DL1 through DLm extend substantially in a column direction to be substantially parallel to each other. The data lines and the scan lines are substantially orthogonal to each other.

Although only the scan lines SL1 through SLn and the data lines DL1 through DLm are connected to the pixels PX in the drawing, various signal lines can be additionally connected to the pixels PX depending on the structure or driving method of the pixels PX.

The pixel driving unit DU comprises hardware including a signal controller 100, a scan driver 200, a data driver 300, a gray voltage generator 400, and a power supply unit 500. Each component of the pixel driving unit DU may be connected, as an integrated circuit, to a display panel (not illustrated) having the image display unit PU by a tape carrier package (TCP). Alternatively, a circuit may be directly formed in an area of the display panel where the pixels PX are not formed.

The signal controller 100 receives input control signals including an image signal R, G, B, a data enable signal DE, a horizontal synchronization signal Hsync, a vertical synchronization signal Vsync, and a main clock signal MCLK.

The image signal R, G, B includes information about luminance levels of a plurality of pixels. For example, the luminance levels may correspond to a predetermined number of gray levels, for example, 1024 (=210), 256 (=28), or 64 (=26) gray levels, respectively. The image signal R, G, B may be converted by the signal controller 100 into an image data signal DATA including information about gray levels that should used by the pixels PX for display.

With continued reference to FIG. 1, the signal controller 100 generates a scan driver control signal CONT1, a data driver control signal CONT2, a gray voltage generator control signal CONT3, a power supply unit control signal CONT4, and the image data signal DATA in response to the image signal R, G, B, the data enable signal DE, the horizontal synchronization signal Hsync, the vertical synchronization signal Vsync and the main clock signal MCLK.

The signal controller 100 provides the image data signal DATA, the data driver control signal CONT2, and a lookup table selection signal LSS to the data driver 300. The data driver control signal CONT2 is a signal that controls the operation of the data driver 300 and may include a horizontal synchronization start signal (not illustrated) for notifying the start of transmission of the image data signal DATA, a load signal (not illustrated) for instructing the output of data signals D1 through Dm to the data lines DL1 through DLm, and a data clock signal (not illustrated). The data driver control signal CONT2 may further include, for example, an inversion signal (not illustrated) for inverting the voltage polarity of the image data signal DATA with respect to a common voltage (not illustrated).

The lookup table selection signal LSS includes, for example, information about voltage levels of the data signals D1 through Dm that the data driver 300 should provide to the image display unit PU based on gray values included in the image data signal DATA. This part of the inventive concept will be described in detail later.

The signal controller 100 provides the scan driver control signal CONT1 to the scan driver 200. The scan driver control signal CONT1 may include, for example, one or more signals that may be commands, e.g. a scan start signal (not illustrated) for the scan driver 200, and may include at least one clock signal for controlling the output of scan-on voltages which are on-state voltages of scan signals S1 through Sn. The scan driver control signal CONT1 may further include an output enable signal (not illustrated) that may limit a duration of the scan-on voltages to periods when the output enable signal is at a predetermined logic level, or for example, activates a latch.

The data driver 300 is connected to the data lines DL1 through DLm disposed in the image display unit PU and receives the reference gray voltages VGMA from the gray voltage generator 400. The data driver 300 processes the received reference gray voltages VGMA and provides the processed reference gray voltages VGMA to the data lines DL1 through DLm as the data signals D1 through Dm. To simplify construction, it is within the inventive concept that the gray voltage generator 400 may provide only a predetermined number of reference gray voltages VGMA instead of providing voltages for all gray levels. Here, the data driver 300 may divide the reference gray voltages VGMA into gray voltages for all gray levels and select the data signals D1 through Dm from the gray voltages for all gray levels.

The scan driver 200 provides the scan lines SL1 through SLn with the scan signals S1 through Sn, each composed of a scan-on voltage for turning on switching elements Qpx (see FIG. 2) connected to one of the scan lines SL1 through SLn of the image display unit PU and a scan-off voltage for turning off the switching elements Qpx.

The power supply unit 500 receives a power supply voltage VDD from an external source and receives the power supply unit control signal CONT4 from the signal controller 100. The power supply unit 500 converts the power supply voltage VDD and provides the converted power supply voltage VDD to the scan driver 200 and the gray voltage generator 400. The power supply unit 500 provides a scan-on voltage Von and a scan-off voltage Voff to the scan driver 200 and a driving voltage AVDD to the gray voltage generator 400.

The gray voltage generator 400 receives the scan driver control signal CONT3 from the signal controller 100 and receives the driving voltage AVDD from the power supply unit 500. Then, the gray voltage generator 400 generates a plurality of reference gray voltages VGMA and provides the generated reference gray voltages VGMA to the data driver 300.

Figure 2:
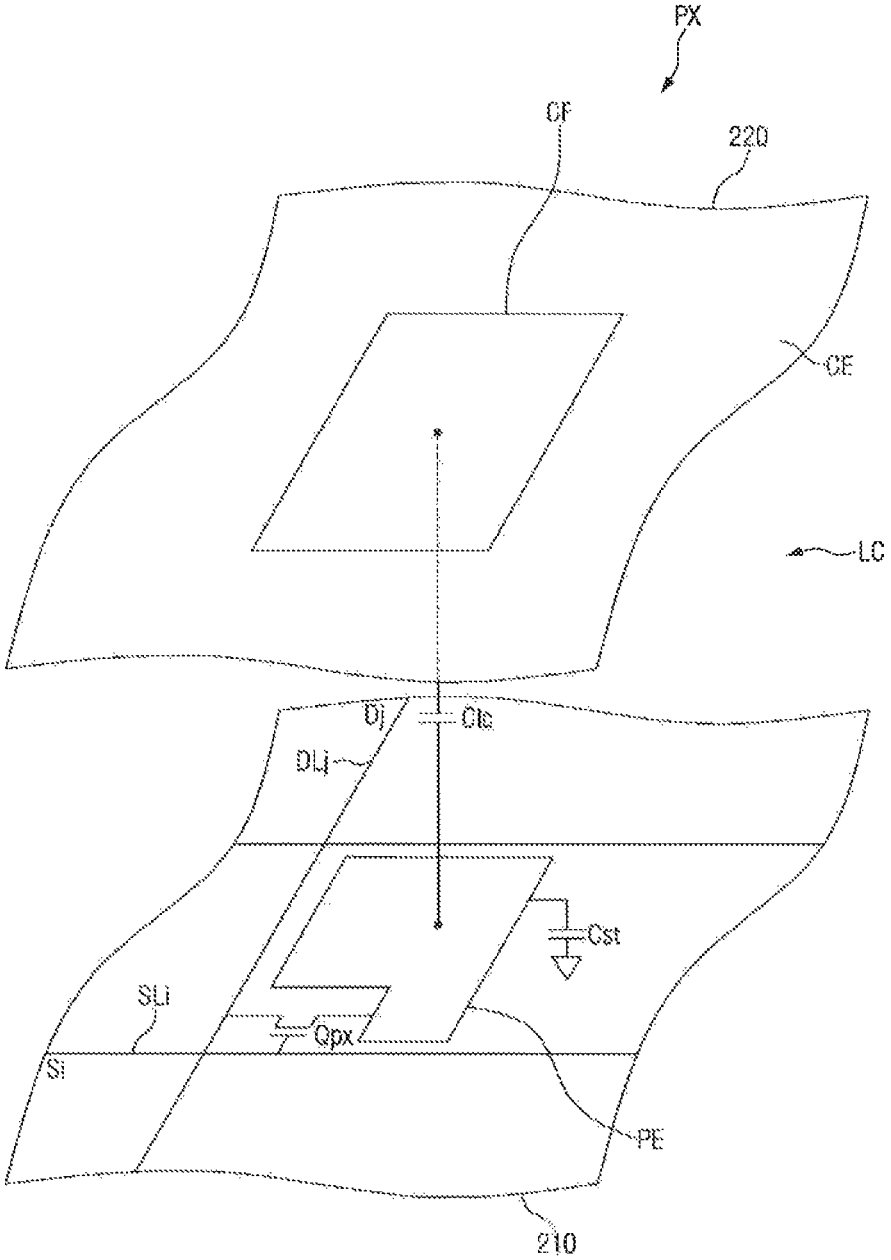
FIG. 2 is an equivalent circuit diagram of one pixel of the LCD according to the embodiment of FIG. 1.

FIG. 2 is an equivalent circuit diagram of one pixel of the LCD such as shown in the embodiment of FIG. 1.

Referring now to FIG. 2, a pixel PX includes a first substrate 210 on which a switching element Qpx and a pixel electrode PE are formed, a second substrate 220 on which a color filter CF and a common electrode CE are formed, and liquid crystal molecules LC interposed between the first substrate 210 and the second substrate 220. The color filter CF faces the pixel electrode PE of the first substrate 210. In the current embodiment, the color filter CF is formed on the second substrate 220. However, the color filter CF may be formed on the first substrate 210.

A pixel PXij connected to an $i^{th}$ scan line SLi (where i is one of 1 through n) and a $j^{th}$ data line DLj (where j is one of 1 through m) includes a switching element Qpx connected to the $i^{th}$ scan line SLi and the $j^{th}$ data line DLj and a liquid crystal capacitor Clc and a storage capacitor Cst connected to the switching element Qpx. The storage capacitor Cst can be omitted. The construction may employ thin-film technology, for example, the switching element Qpx may be a thin-film transistor.

Figure 3:
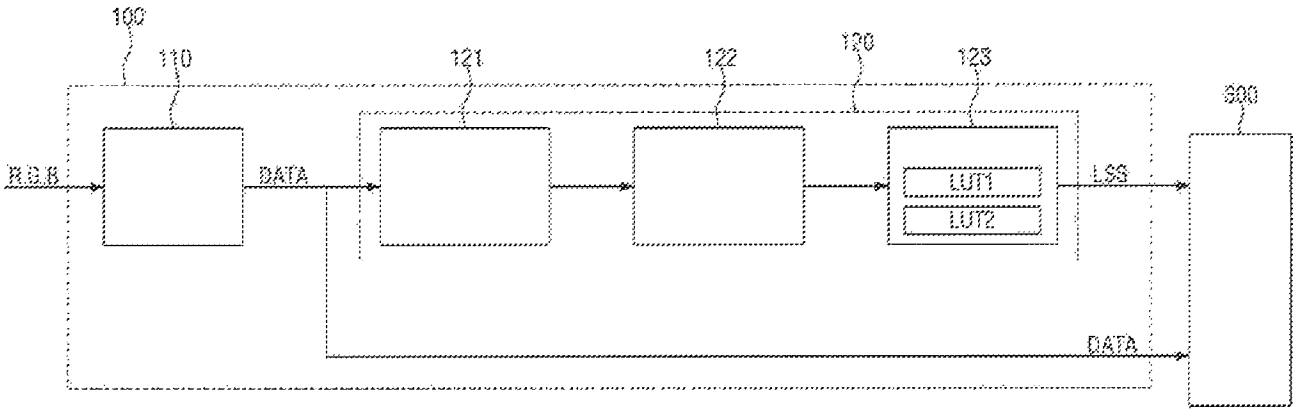
FIG. 3 is a block diagram of a signal controller according to an embodiment of the inventive concept.
Figure 4:
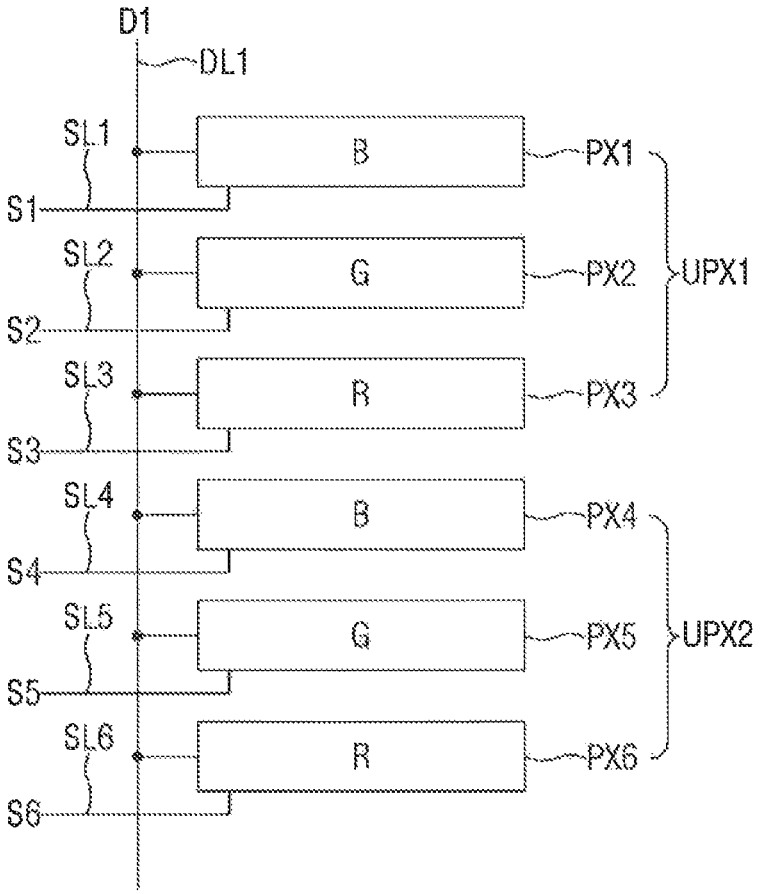
FIG. 4 is a schematic diagram illustrating some pixels included in an image display unit of FIG. 1 and signal lines connected to the pixels.
Figure 5:
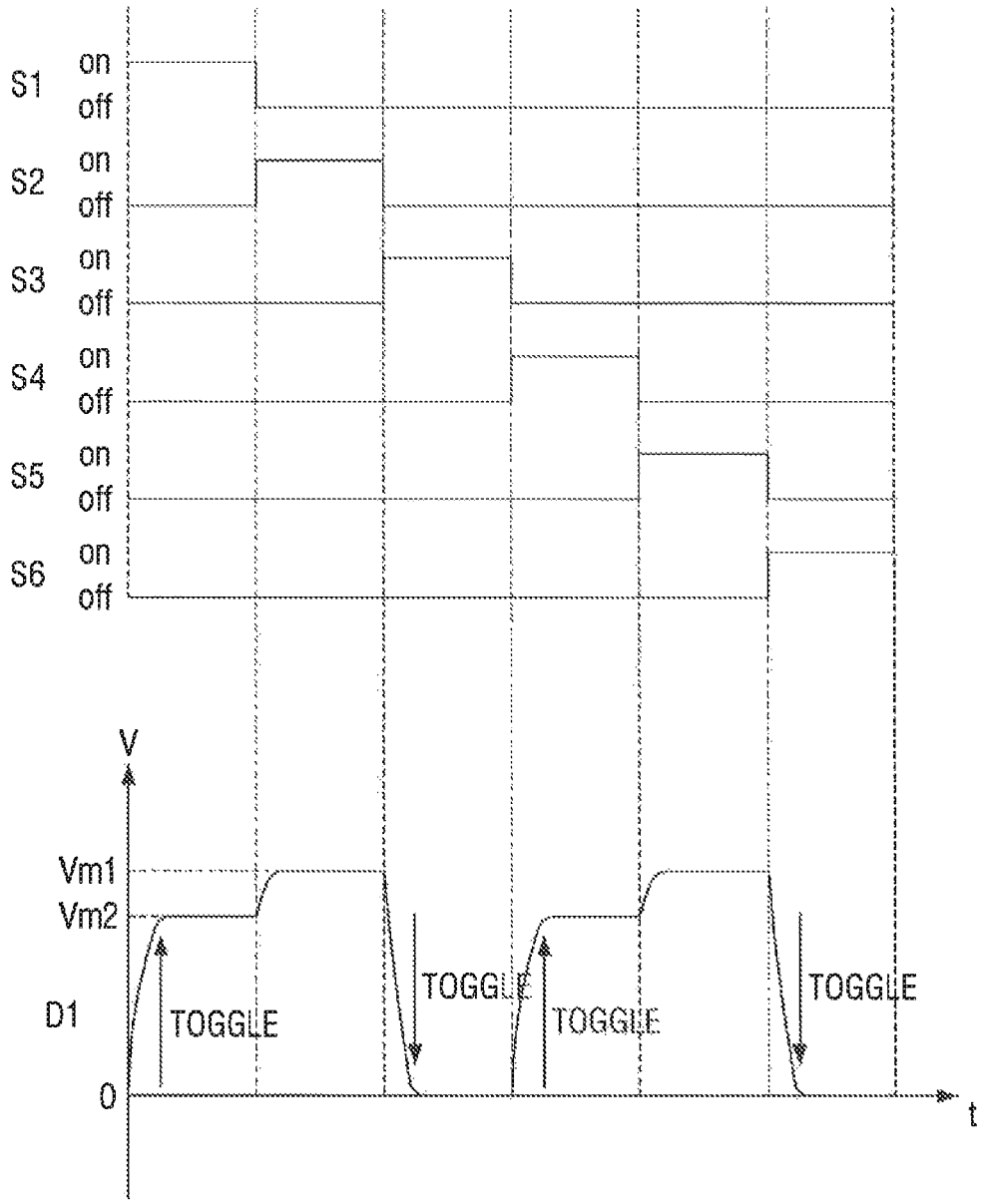
FIG. 5 is a waveform diagram of signals for driving the pixels of FIG. 4 in an example where a first lookup table is used.
Figure 7:
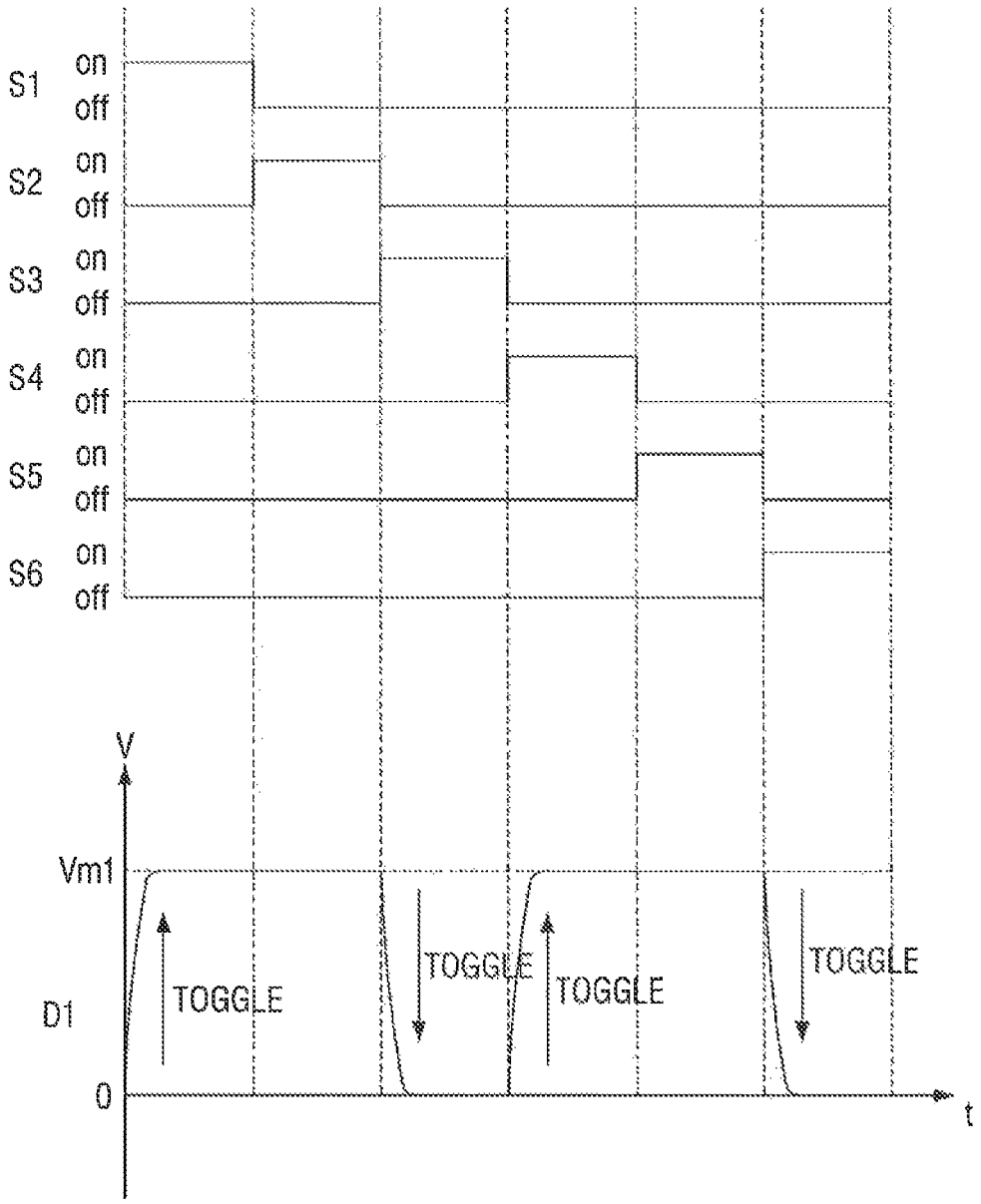
FIG. 7 is a waveform diagram of the signals for driving the pixels of FIG. 4 in an example where a second lookup table is used.

FIG. 3 is a block diagram of a signal controller 100 according to an embodiment of the inventive concept. FIG. 4 is a schematic diagram illustrating some pixels included in the image display unit of FIG. 1 and signal lines connected to the pixels. FIG. 5 is a waveform diagram of signals for driving the pixels of FIG. 4 in a case where a first lookup table LUT1 is used. FIG. 6 illustrates the first lookup table LUT1. FIG. 7 is a waveform diagram of the signals for driving the pixels of FIG. 4 in a case where a second lookup table LUT2 is used. FIG. 8 illustrates the second lookup table LUT2.

Referring now to FIG. 3, the signal controller 100 may include an image signal conversion unit 110 and an overheat prevention unit 120 (hereinafter overheat prevention circuit 120). In FIG. 3, signals related to particularly the overheat prevention circuit 120 of the signal controller 100 are mainly illustrated, and other components are omitted.

The image signal conversion unit 110 may convert the image signal R, G, B received from an external source into the image data signal DATA including information about gray levels that the pixels PX should actually display and provide the image data signal DATA to the data driver 300. In addition, the image signal conversion unit 110 may provide the image data signal DATA to the overheat prevention circuit 120.

The overheat prevention circuit 120 receives the image data signal DATA from the image signal conversion unit 110 and analyzes the image data signal DATA to perform compensation for preventing the overheating of the data driver 300. If the image data signal DATA includes a pattern or an image that will cause the data driver 300 to overheat, the overheat prevention circuit 120 detects the pattern or the image and changes a lookup table used for driving the data driver 300, thereby preventing the data driver 300 from overheating.

More specifically, the overheat prevention unit 120 may include a detector 121, a comparator 122, and a lookup table selector 123.

With continued reference to FIG. 3, the detector 121 receives the image data signal DATA from the image signal conversion unit 110, analyzes an image displayed in each frame, and detects the number of toggles. A person of ordinary skill the art should understand that a toggle is defined as a case where the amount of change (e.g. Δ gray levels) in gray levels of successive pixels controlled by the same data line (one of DL1 through DLm) is equal to or greater than a reference gray change amount. The reference gray change amount may be defined as a gray change amount (e.g. Δ gray levels) by which the gray levels of successive pixels PX are changed to 90% or more of a maximum gray level. As the number of toggles detected while one frame is displayed increases, the amount of change in the gray levels of successive pixels PX may often be large, and may be relatively larger than a case where the number of toggles while one frame is displayed decreases or remains about the same. In addition, as the amount of change in the gray levels of the successive pixels PX becomes larger, a data signal (one of D1 through Dm) provided to a corresponding data line (one of DL1 through DLm) may be changed significantly and frequently. Therefore, the data driver 300 can become overloaded and may overheat, adversely affecting the operation of the data driver and may cause damage to the data driver. In this regard, the number of toggles occurring in one frame may be detected in advance using the image data signal DATA to predict whether the data driver 300 will overheat. When there is, for example, an increased likelihood that overheating of the data driver may occur, some preemptive operations may prevent or delay the driver from overheating.

According to the inventive concept, the toggles will now be described in more detail with reference to FIGS. 4 and 5.

FIG. 4 illustrates a group of six pixels PX1 through PX6 whose gray levels are controlled by the first data line DL1. The six pixels PX1 through PX6 will be named as a first pixel PX1, a second pixel PX2, a third pixel PX3, a fourth pixel PX4, a fifth pixel PX5 and a sixth pixel PX6 and may be controlled by the first through sixth scan lines SL1 through SL6, respectively. In this example, the first through sixth pixels PX1 through PX6 may correspond to pixels PX arranged in a first row and a first column through a sixth row and the first column among the pixels PX arranged in the image display unit PU according to the embodiment of FIG 1.

As can be seen in FIG. 4, long axes of the first through sixth pixels PX1 through PX6 may be parallel to a direction in which the first through sixth scan lines SL1 through SL6 extend, and short axes of the first through sixth pixels PX1 through PX6 may be parallel to a direction in which the first data line DL1 extends. Accordingly, from the viewpoint of FIG. 4, the first through sixth pixels PX1 through PX6 may be relatively longer in a horizontal direction than in a vertical direction, and three pixels PX successively arranged in the vertical direction may form a shape close to a square. Three pixels PX arranged in the vertical direction may form one upper pixel UPX1 or UPX2 defined as a minimum unit whose color can be controlled. A group of the first through third pixels PX1 through PX may be defined as a first upper pixel UPX1, and a group of the fourth through sixth pixels PX4 through PX6 may be defined as a second upper pixel UPX2.

In the non-limiting example shown in FIG. 4, the first pixel PX1 and the fourth pixel PX4 may display blue, the second pixel PX2 and the fifth pixel PX5 may display green, and the third pixel PX3 and the sixth pixel PX6 may display red. However, the inventive concept is broader than as shown in FIG. 4, and the colors displayed by the first through sixth pixels PX1 through PX6 may be changed. In addition, one upper pixel is not necessarily composed of three pixels PX but may also be composed of a quantity of pixels PX other than three.

FIG. 5 illustrates waveforms of the first through sixth scan signals S1 through S6 illustrated in FIG. 4 provided to the first through sixth scan lines SL1 through SL6. The first data signal D1 is provided to the first data line DL1 in a case where the two upper pixels UPX1 and UPX2 illustrated in FIG. 4 display cyan. Cyan is a color that is displayed when blue and green are mixed. Therefore, it is assumed that the cyan color illustrated in FIG. 5 is displayed when the first pixel PX1 and the fourth pixel PX4, which are blue, emit light at a maximum gray level, the second pixel PX2 and the fifth pixel PX5, which are green, emit light at the maximum gray level, and the third pixel PX3 and the sixth pixel PX6, which are red, emit light at a minimum gray level.

In addition, it is assumed that the first through sixth pixels PX1 through PX6 shown in FIG. 4 are driven sequentially, and elements of row inversion driving, column inversion driving, and dot inversion driving will be excluded from the following description. Although the elements of the row inversion driving, the column inversion driving and the dot inversion driving are omitted, the concept of such inversion driving can be applied to determine the waveform of each of the data signals D1 through Dm and the waveform of each of the scan signals S1 through Sn. However, even if the concept of the inversion driving is applied, the same effect of suppressing heat generation according to the inventive concept can be brought about.

First, assuming that a reference voltage of the first data signal D1 transmitted to the first data line DL1 is 0 [V], when the first pixel PX1 displays blue of the maximum gray level, the first data signal D1 is changed by Vm2 [V] from 0 [V] to Vm2 [V]. In addition, when the second pixel PX2 displays green of the maximum gray level, the first data signal D1 is changed by Vm1-Vm2 [V] from Vm2 [V] to Vm1 [V] (the reason why a voltage level of the first data signal D1 which corresponds to the maximum gray level of blue is different from a voltage level of the first data signal D1 which corresponds to the maximum gray level of green will be described later). Also, when the third pixel PX3 displays red of the minimum gray level, the first data signal D1 is changed by Vm1 [V] from Vm1 [V] to 0 [V].

For example, when the first upper pixel UPX1 emits cyan light of the maximum gray level, the first pixel PX1, the second pixel PX2 and the third pixel PX3 constituting the first upper pixel UPX1 emit red light of the maximum gray level, green light of the maximum gray level, and red light of the minimum gray level, respectively. Therefore, one toggle occurs in the process in which the first pixel PX1 displays the blue of the maximum gray level, and one toggle occurs in the process in which the third pixel PX3 displays the red of the minimum gray level. In the process in which the second pixel PX2 displays the green of the maximum gray level, the amount of change in the voltage level of the first data signal D1 is not large because the first pixel PX1 which is a previous pixel is already displaying the blue of the maximum gray level. Therefore, no toggle may occur. Consequently, when the first upper pixel UPX1 emits the cyan light of the maximum gray level, two toggles occur.

Similarly, when the second upper pixel UPX2 emits the cyan light of the maximum gray level, two toggles occur while the fourth pixel PX4, the fifth pixel PX5, and the sixth pixel PX6 are driven.

For example, when x pixels PX (where x is a natural number which is a multiple of 3) display the cyan color of the maximum gray level, a total of x*⅔) toggles may occur.

The same concept may be applied not only to a case where cyan is displayed, but also to a case where magenta or yellow is displayed, or to cases where red, blue and green monochromatic colors are displayed. For example, when any one of cyan, magenta, yellow, and red, blue and green monochromatic colors is displayed, a total of (x*⅔) toggles may occur per x pixels PX even if the timing of a toggle is different.

The comparator 122 (FIG. 3) receives information about the number of toggles included in each frame from the detector 121, determines whether the number of toggles included in each frame is equal to or greater than a reference number of toggles, and provides information about the comparison result to the lookup table selector 123.

Here, the reference number of toggles is defined as the number of toggles included in one frame that may cause the data driver 300 to overheat. The reference number of toggles may be initially set at the time of production of a display device, and its value may be modified by changing settings even after production of the display device. For example, a value (e.g., a total number of the pixels PX) obtained by multiplying the number of the data lines DL1 through DLm connected to the data driver 300 by the number of the scan lines SL1 through SLn connected to the scan driver 200, may be multiplied by ⅔, which is a ratio of the number of toggles occurring when a monochromatic color is displayed to the total number of the pixels PX, and may be additionally multiplied by 0.7, which is the proportion of an area occupied by the monochromatic color in the entire image. Then, the multiplication result may be determined as the reference number of toggles. The criterion for determining the proportion as 0.7 will be described later. For example, when the number of toggles included in one frame is (m*n*⅔*0.7) or more, the data driver 300 can overheat. According to the inventive concept, the data driving may be performed in a way that prevents overheating. A person of ordinary skill in the art should appreciate that in the inventive concept, the reference number of toggles is not limited to the above example and can be changed to other values. More specifically, when the data driver 300 is manufactured, for example, using a plurality of data driving chips, the reference number of toggles may be determined in consideration of the number of data lines (some of DL1 through DLm) connected to one driving chip, so that heat generation can be managed on a data driving chip-by-data driving chip basis. In addition, the number of the scan lines SL1 through SLn, the ratio of the number of toggles to the total number of the pixels PX, and the proportion of the area occupied by the monochromatic color in the entire image can all be changed. This concept will be subsequently described herein in more detail.

With reference to FIG. 3, the lookup table selector 123 receives from the comparator 122 information about whether the number of toggles included in each frame is equal to or greater than the reference number of toggles, selects any one of a plurality of lookup tables LUT1 and LUT2 based on the received information, and provides the selected lookup table LUT1 or LUT2 to the data driver 300. The information about the selected lookup table LUT1 or LUT2 provided to the data driver 300 may be the lookup table selection signal LSS.

The lookup table selector 123 may store information about the first lookup table LUT1 and the second lookup table LUT2. Here, each of the first lookup table LUT1 and the second lookup table LUT2 includes information about values of voltage levels that the data driver 300 should actually output to the data lines DL1 through DLm as the data signals D1 through Dm based on gray values included in the image data signal DATA received from the signal controller 100. The first lookup table LUT1 and the second lookup table LUT2 may not necessarily be stored in the lookup table selector 123, and a separate memory (not illustrated) can be provided outside the signal controller 100 and connected to the lookup table selector 123, so that the information about the first lookup table LUT1 and the second lookup table LUT2 can be retrieved from the external memory. The information about the first lookup table LUT1 and the second lookup table LUT2 may be descriptive, or cumulative, in the event that the actual lookup tables are not stored in the lookup table selector 123. In addition, while lookup tables are used because in general there is faster access, a person of ordinary skill in the art should understand and appreciate that according to the inventive concept that there are other ways that the values may be stored in addition to or instead of a lookup table.

The first and second lookup tables LUT1 and LUT2 will now be described with reference to FIGS. 6 through 8.

Referring to FIG. 6, in the first lookup table LUT1, the data signals D1 through Dm having the same voltage level are set to be output for all of blue, green and red for gray levels of 0 to 243. However, for gray levels of 245 and above, the data signals D1 through Dm having relatively lower voltage levels are set to be output for blue than for green and red. In an example, for a maximum gray level of 255, the data signals D1 through Dm having a voltage level corresponding to 245 are output for blue, but the data signals D1 through Dm having a voltage level corresponding to 255 are output for green and red, On the other hand, referring now to FIG. 8, in the second lookup table LUT2, the data signals D1 through Dm having the same voltage level are set to be output for blue, green and red for all gray levels of 0 to 255.

Therefore when the data driver 300 is driven using the first lookup table LUT1, the data signals D1 through Dm having a relatively lower voltage level may be output when pixels PX displaying blue have a maximum gray value than when pixels PX displaying green and red have the maximum gray value. On the other hand, when the data driver 300 is driven using the second lookup table LUT2, the data signals D1 through Dm having the same voltage level may be output when the pixels PX displaying blue, green and red have the maximum gray value.

For example, when the first lookup table LUT1 is used, the data signals D1 through Dm for the pixels PX displaying blue of the maximum gray value may be adjusted to have a relatively lower voltage level than that of the data signals D1 through Dm for the pixels PX displaying red and green of the maximum gray value. On the other hand, when the second lookup table LUT2 is used, such adjustment may not be performed. The adjustment is a correction made because the pixels PX displaying blue look relatively bright compared with pixels display other colors even if they receive the data signals D1 through Dm having the same voltage level as that of the data signals D1 through Dm transmitted to the pixels PX displaying green and red. Specifically, when the second lookup table LUT2 is used, the voltage level of the data signals D1 through Dm corresponding to the gray value of the image data signal DATA for the pixels PX displaying blue may be lowered (corrected) to be in a normal color gamut range to correct a phenomenon in which blue is viewed out of the normal gamut range as the gray value becomes closer to the maximum gray value.

Therefore, when the data driver 300 is driven using the first lookup table LUT1, even if two successive pixels PX are driven to have the maximum gray value, a data signal (one of D1 through Dm) may be changed if any one of the two pixels displays blue. This change in the data signal may be one of the factors that cause the data driver 300 to generate heat. Therefore, when the data driver 300 is driven using the second lookup table LUT2, heat generation can be reduced compared with when the data driver 300 is driven using the first lookup table LUT1.

Hence, when the lookup table selector 123 receives from the comparator 122 information indicating that the number of toggles included in each frame is equal to or greater than the reference number of toggles, there can be a selection for the data driver 300 to be driven based on the first lookup table LUT1 to be driven based on the second lookup table LUT2. Accordingly, the beat generation of the data driver 300 can be reduced.

The values shown in the first lookup table LUT1 and the second lookup table LUT2 of FIGS. 6 and 8 are exemplary values, and actual values can be changed depending on a degree of correction. For example, an output gray value converted from each gray value corresponding to 90% or more of the maximum gray value of blue included in the first lookup table LUT1 may be smaller than an output gray value converted from each gray value corresponding to 90% or more of the maximum gray value of red and green included in the first lookup table LUT1.

Controlling heat generation by selecting the first lookup table LUT1 or the second lookup table LUT2 can be more clearly understood by comparing FIG. 5 with FIG. 7.

As described above, FIG. 5 is a waveform diagram of signals for driving the pixels such as shown in FIG. 4 in a case where the first lookup table LUT1 is used, and FIG. 7 is a waveform diagram of the signals for driving the pixels of FIG. 4 in a case where the second lookup table LUT 2 is used.

Similarly to FIG. 5, FIG. 7 illustrates waveforms of the first through sixth scan signals S1 through S6 provided to the first through sixth scan lines SL1 through SL6 and the first data signal D1 provided to the first data line DL1 in a case where the two upper pixels UPX1 and UPX2 illustrated in FIG. 4 display cyan. Cyan is a color displayed when blue and green are mixed. Therefore, it is assumed that the waveforms illustrated in FIG. 7 correspond to when the color cyan is displayed. For example, when the first pixel PX1 and the fourth pixel PX4, which are blue, emit light at the maximum gray level, the second pixel PX2 and the fifth pixel PX5, which are green, emit light at the maximum gray level, and the third pixel PX3 and the sixth pixel PX6, which are red, emit light at the minimum gray level.

For example, assuming that the reference voltage of the first data signal D1 transmitted to the first data line DL1 is 0 [V], when the first pixel PX1 displays blue of the maximum gray level, the first data signal D1 is changed by Vm1 [V] from 0 [V] to Vm1 [V]. In addition, when the second pixel PX2 displays green of the maximum gray level, the first data signal D1 is not changed but is maintained at Vm1 [V], which is different from the waveform diagram of FIG. 5. Also, when the third pixel PX3 displays red of the minimum gray level, the first data signal D1 is changed by Vm1 [V] from Vm1 [V] to 0 [V].

As described above, according to the inventive concept, when cyan is displayed, if the data driver 300 is driven using the second lookup table LUT2, the pixels PX displaying blue at the maximum gray value are not corrected. Thus, heat generation can be reduced. Specifically, when cyan is displayed based on the second lookup table LUT2, two toggles occur per one upper pixel UPX1 or UPX2 as when based on the first lookup table LUT1. However, since the data signals D1 through Dm are not changed at the time of conversion from the maximum gray level of blue to the maximum gray level of green, the load on the data driver 300 is reduced, thereby reducing heat generation.

In addition, the reason why a value obtained by multiplying the number of toggles by 0.7, which is the proportion of the area occupied by a monochromatic color in the entire image, is determined as the reference number of toggles will now be described with reference to Table 1 below.

Table 1 below shows values obtained by measuring the temperature of the data driver 300 according to the proportion of the area occupied by a monochromatic color in the image display unit PU when the data driver 300 is driven using the first lookup table LUT1. The data driver 300 is composed of a total of four data driving chips which will be referred to as a first data driver DDI1, a second data driver DDI2, a third data driver DDI3, and a fourth data driver DDI4, respectively. Each of the first through fourth data drivers DDI1 through DDI4 may correspond to a separate data driving chip.

TABLE 1

| | 0% | 50% | 60% | 65% | 70% | 80% | 90% | 100% |
|---|---|---|---|---|---|---|---|---|
| DDI 1 | 89.65 | 121.7 | 134.6 | 138.1 | 140.2 | 144.4 | 161.3 | 168.1 |
| DDI 2 | 88.1 | 130 | 135.1 | 141.3 | 142.3 | 152.6 | 165.8 | 176 |
| DDI 3 | 90.1 | 130 | 136.8 | 142.5 | 143.8 | 153.2 | 169.1 | 173.5 |
| DDI 4 | 88.2 | 121.7 | 135.2 | 139.8 | 141.9 | 145.9 | 163.2 | 165.6 |

First, when the proportion of the area occupied by the monochromatic color in the image display unit PU is 0%, all of the first through fourth data drivers DDI1 through DDI4 maintain a temperature of 100 degrees or below. In addition, the temperatures of the first through fourth data drivers DDI1 through DDI4 tend to increase as the proportion of the area occupied by the monochromatic color in the image display unit PU increases.

However, when the temperatures of the first through fourth data drivers DDI1 through DDI4 are 500 degrees or above, significant damage can be done to a display device. Therefore, the first through fourth data drivers DDI1 through DDI4 should be maintained at a temperature of 150 degrees or below. In this case, if the proportion of the area occupied by the monochromatic color in the image display unit PU is 80% or more, the temperatures of the second data drive driver DDI2 and the third data drive driver DDI4 exceed 150 degrees. Therefore, when the proportion of the area occupied by the monochromatic color in the image display unit PU is 70% or more, the data driver 300 may be controlled to be driven using the second lookup table LUT2, so that the heat generation of the data driver 300 can be minimized.

However, the proportion of the area occupied by the monochromatic color in the image display unit PU is not limited to 70% or more and can be changed to any rate when the maximum allowable temperature of the data driver 300 is set to a temperature other than 150 degrees or when the specifications of the data driving chips constituting the data driver 300 are changed.

Figure 9:
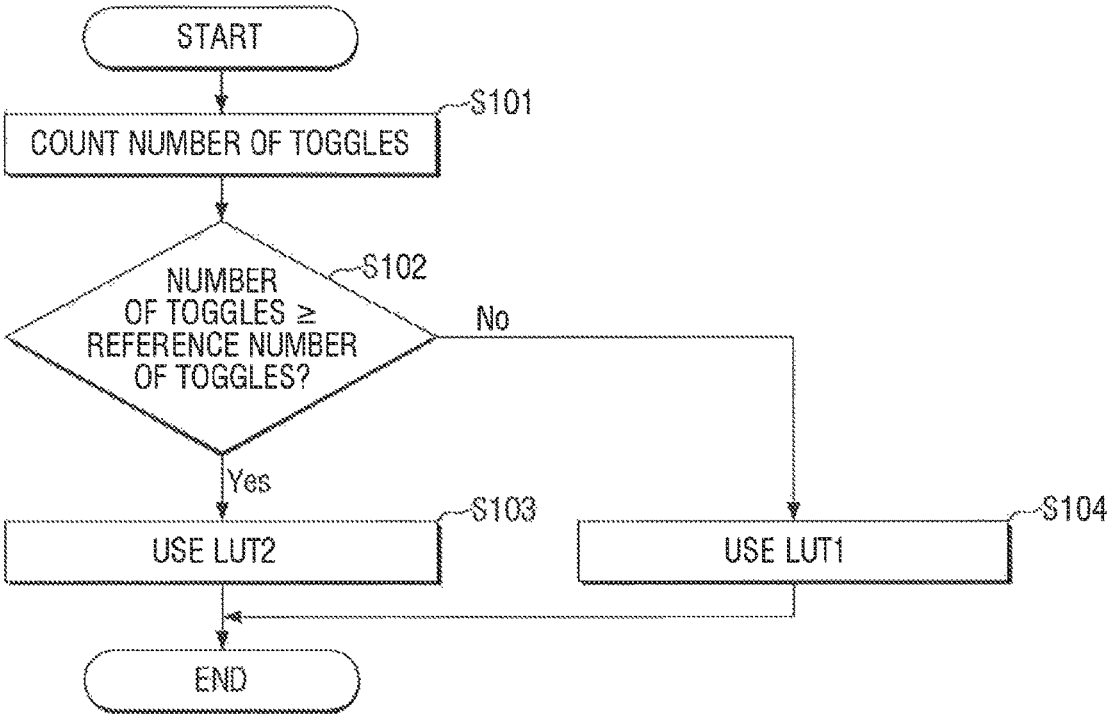
FIG. 9 is a flowchart illustrating the operation of an overheat prevention circuit of the display device according to the embodiment of FIG. 3.

FIG. 9 is a flowchart illustrating the operation of the overheat prevention circuit 120 of the display device according to the embodiment including the signal controller of FIG. 3.

Referring to FIG. 9, at operation (S101), the detector 121 counts the number of toggles included in each frame by using the input image data signal DATA.

Next, at operation (S102), the comparator 122 receives information about the number of toggles included in each frame from the detector 121 and determines whether the number of toggles included in each frame is equal to or greater than a reference number of toggles.

When it is determined at operation (S102) that the number of toggles included in each frame is equal to or greater than the reference number of toggles then at operation (S103) the lookup table selector 123 controls the data driver 300 to be operated using the value(s) of the second lookup table LUT2. On the contrary, when it is determined at operation (S102) that the number of toggles included in each frame is not equal to or greater than the reference number of toggles, then at operation (S1004) the lookup table selector 123 controls the data driver 300 to be operated using value(s) of the first lookup table LUT1.

Figure 10:
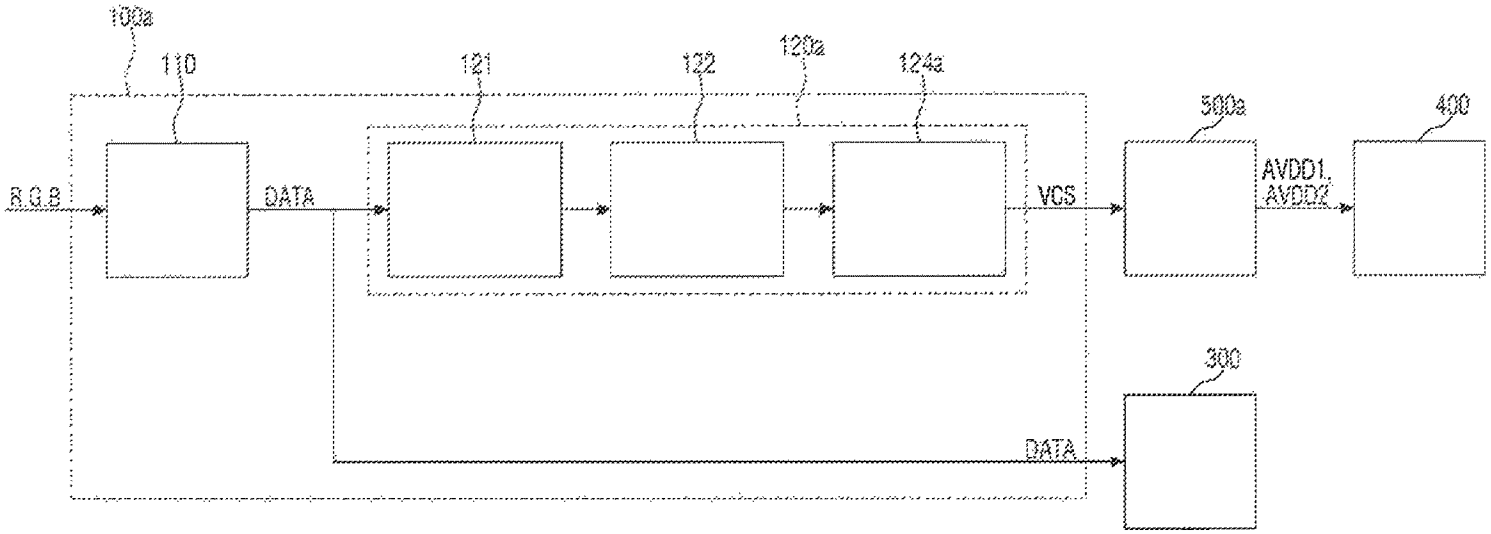
FIG. 10 is a block diagram of a signal controller according to an embodiment of the inventive concept.

FIG. 10 is a block diagram of a signal controller 100*a* according to an embodiment of the inventive concept.

The lookup table selector 123 included in the overheat prevention circuit 120 of FIG. 3 is replaced by a driving voltage converter 124*a* in FIG. 10. Therefore, the differences of FIG. 10 as compared with the embodiment of FIG. 3 will hereinafter be mainly described, and a description of identical components will be omitted.

Referring now to FIG. 10, the signal controller 100*a* according to the current embodiment includes an image signal conversion unit 110 and an overheat prevention circuit 120*a*.

The image signal conversion unit 110 is substantially the same or similar to that described above in the embodiment of FIG. 3 and thus will not be described here.

The overheat prevention circuit 120*a* includes a detector 121, a comparator 122, and the driving voltage converter 124*a*.

The detector 121 and the comparator 122 are substantially the same or similar to those described above in the embodiment of FIG. 3 and thus will not be described here.

The driving voltage converter 124*a* receives from the comparator 122 information about whether the number of toggles included in each frame is equal to or greater than a reference number of toggles, generates a driving voltage conversion signal VCS, which determines the voltage level of a driving voltage applied by a power supply unit 500*a* to a gray voltage generator 400, based on the received information, and provides the generated driving voltage conversion signal VCS to the power supply unit 500*a*.

More specifically, the power supply unit 500*a* may provide any one of a first driving voltage AVDD1 and a second driving voltage AVDD2 to the gray voltage generator 400. The first driving voltage AVDD1 is generated when the number of toggles included in each frame is less than the reference number of toggles. On the other hand, the second driving voltage AVDD2 is generated when the number of toggles included in each frame is equal to or greater than the reference number of toggles. For example, the first driving voltage AVDD1 may be provided to the gray voltage generator 400 when the data driver 300 is not likely to overheat, and the second driving voltage AVDD2 is provided to the gray voltage generator 400 when the data driver 300 is likely to overheat.

Here, an average voltage level of the second driving voltage AVDD2 may be relatively lower than that of the first driving voltage AVDD1. The gray voltage generator 400 provides reference gray voltages VGMA (see FIG. 1) to a data driver 300 based on the first driving voltage AVDD1 or the second driving voltage AVDD2, and the data driver 300 generates data signals D1 through Dm (see FIG. 1) by using the reference gray voltages VGMA (see FIG. 1). Therefore, voltage levels of the data signals D1 through Dm (see FIG. 1) may be relatively lower when the second driving voltage AVDD2 is used than when the first driving voltage AVDD1 is used. Accordingly, when the power supply unit 500*a* generates and outputs the second driving voltage AVDD2, the voltage levels of the data signals D1 through Dm (see FIG. 1) output from the data driver 300 may be lower than when the power supply unit 500*a* generates and outputs the first driving voltage AVDD1.

Figure 11:
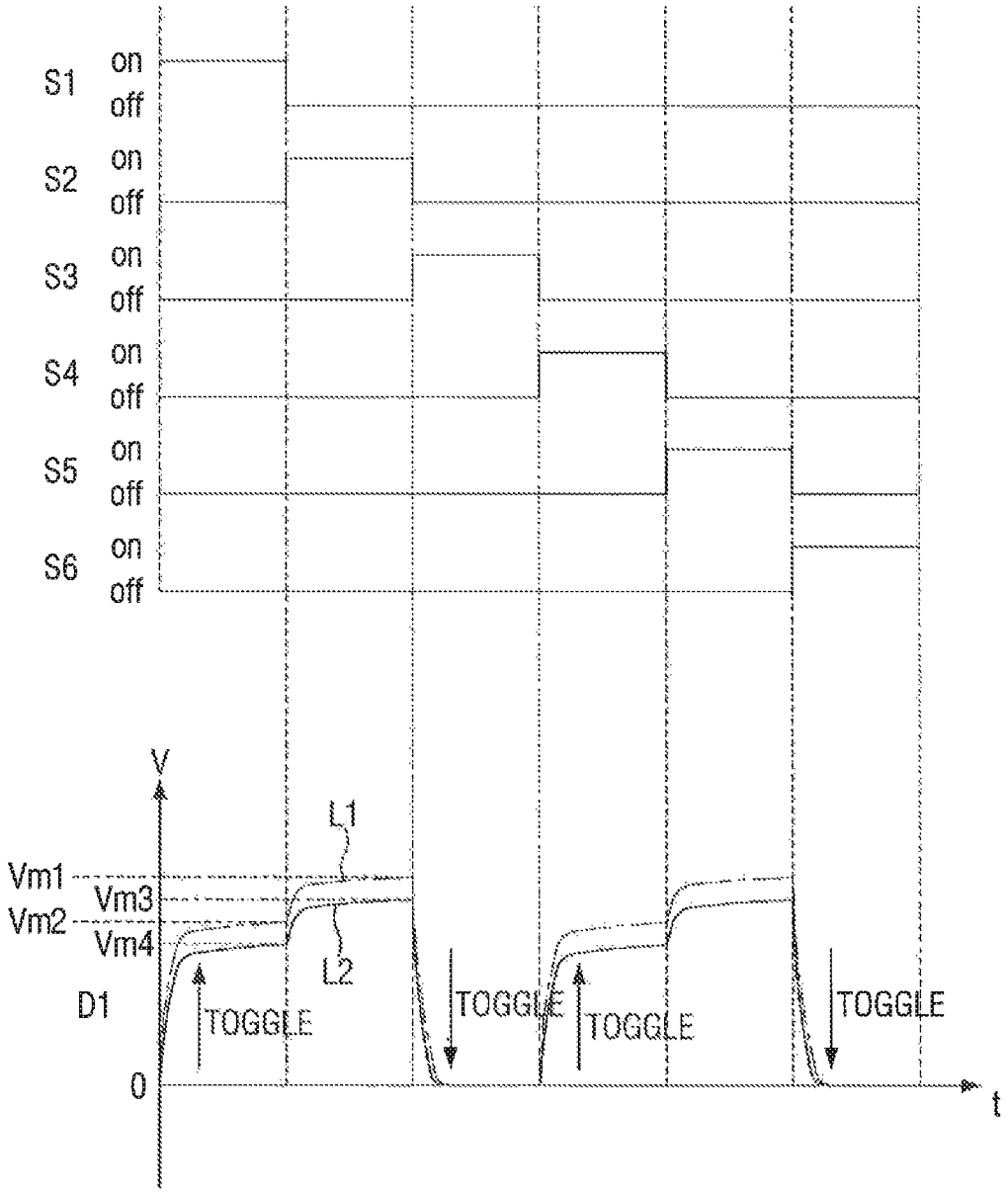
FIG. 11 is a waveform diagram of six pixels corresponding to the pixels of FIG. 4 in a display device according to the embodiment of FIG. 10.

Moreover, FIG. 11 is a waveform diagram of six pixels corresponding to the pixels of FIG. 4 in a display device according to the embodiment of FIG. 10.

In FIG. 11, a voltage level represented by a first line L1 is the voltage level of a first data signal D1 in a case where the first driving voltage AVDD1 is used, and a voltage level represented by a second line L2 is the voltage level of the first data signal D1 in a case where the driving voltage AVDD2 is used. As in the embodiment of FIG. 5, it is assumed in FIG. 11 that each of first through sixth pixels PX1 through PX6 displays cyan.

Referring to FIG. 11, when the first driving voltage AVDD1 is used, a toggle occurs at a time when a first scan signal S1 is turned on, resulting in a voltage change of Vm2 [V], and a toggle occurs at a time when a third scan signal S3 is turned on, resulting in a voltage change of Vm1 [V]. Further, a toggle occurs at a time when a fourth scan signal S4 is turned on, resulting in a voltage change of Vm2 [V], and a toggle occurs at a time when a sixth scan signal S6 is turned on, resulting in a voltage change of Vm1 [V].

On the other hand, when the second driving voltage AVDD2 is used, a toggle occurs at the time when the first scan signal S1 is turned on, resulting in a voltage change of Vm4 [V], and a toggle occurs at the time when the third scan signal S3 is turned on, resulting in a voltage change of Vm3 [V]. Further, a toggle occurs at the time when the fourth scan signal S4 is turned on, resulting in a voltage change of Vm4 [V], and a toggle occurs at the time when the sixth scan signal S6 is turned on, resulting in a voltage change of Vm3 [V].

Here, Vm3 has a voltage value smaller than that of Vm1, and Vm4 has a voltage value smaller than that of Vm2. Therefore, the amount of change in the first data signal D1 may be smaller when the second driving voltage AVDD2 is used, Accordingly, the heat generated from the data driver 300 can be reduced.

Figure 12:
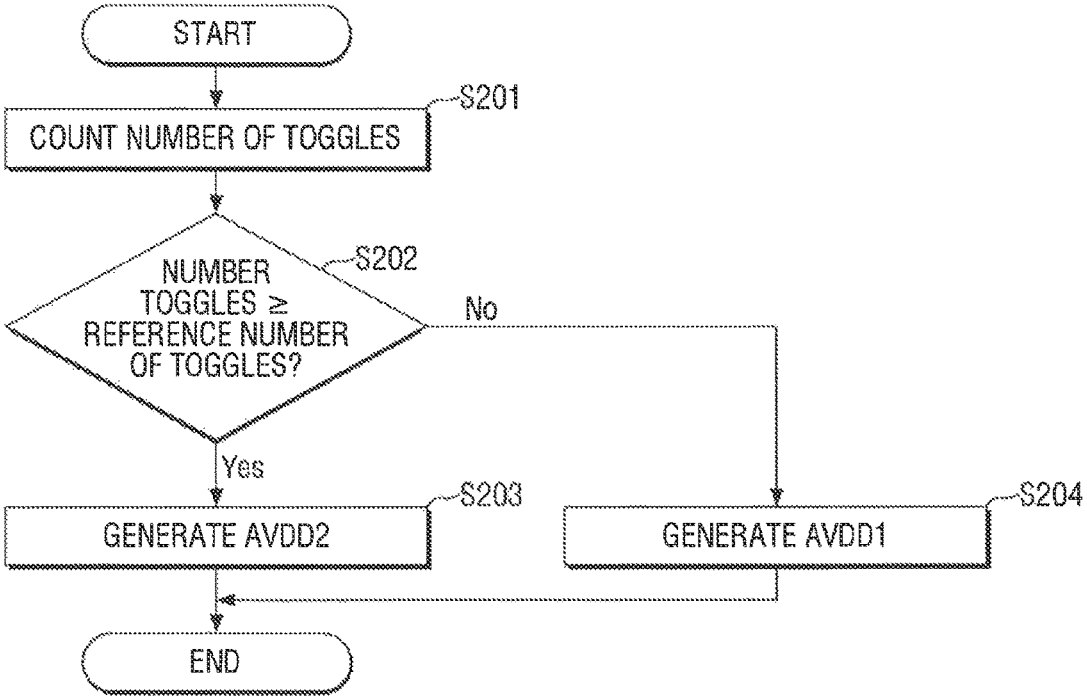
FIG. 12 is a flowchart illustrating the operation of an overheat prevention circuit according to the embodiment of FIG. 10.

FIG. 12 is a flowchart illustrating the operation of the overheat prevention circuit 120*a* according to the embodiment of FIG. 10.

Referring to FIG. 12, at operation (S201), the detector 121 counts the number of toggles included in each frame by using input image data signal DATA.

At operation (S202), the comparator 122 receives information about the number of toggles included in each frame from the detector 121 and determines whether the number of toggles included in each frame is equal to or greater than a reference number of toggles.

When it is determined that the number of toggles included in each frame is equal to or greater than the reference number of toggles, at operation (S203), the driving voltage converter 124*a* controls the power supply unit 500*a* to generate the second driving voltage AVDD2.

On the contrary, when it is determined that the number of toggles included in each frame is not equal to or greater than the reference number of toggles, at operation (S204) the driving voltage converter 124*a* controls the power supply unit 500*a* to generate the first driving voltage AVDD1.

Figure 13:
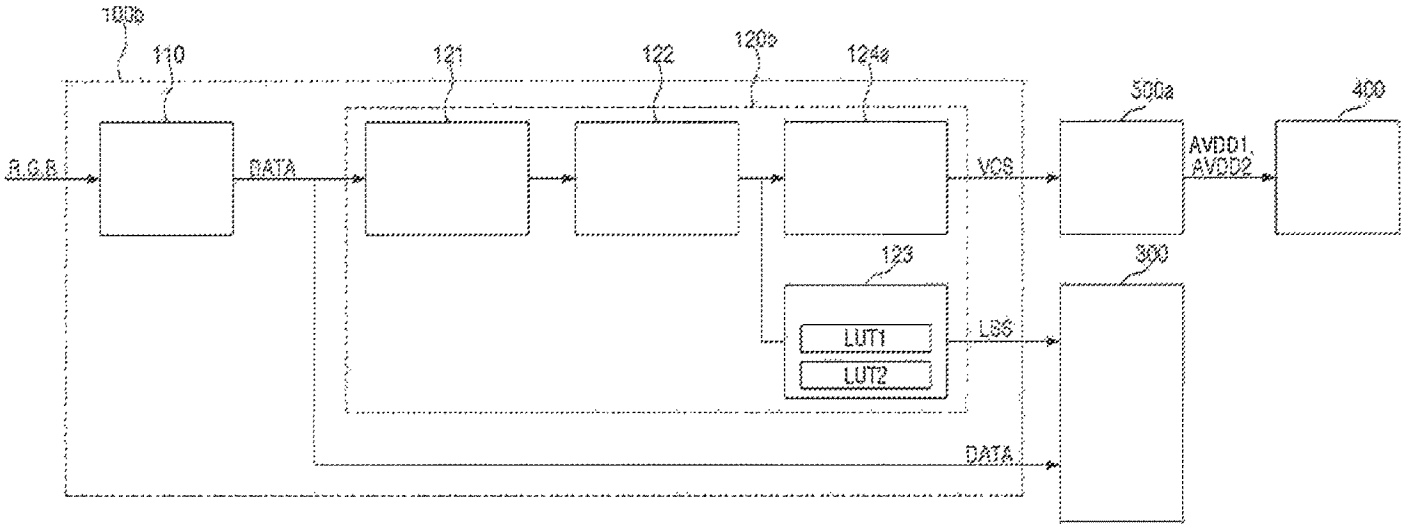
FIG. 13 is a block diagram of a signal controller according to an embodiment of the inventive concept.

FIG. 13 is a block diagram of a signal controller 100*b* according to an embodiment of the inventive concept.

Referring now to FIG. 13, an overheat prevention circuit 120*b* according to the current embodiment includes both the lookup table selector 123 (see FIG. 3) included in the overheat prevention circuit 120 (see FIG. 3) according to the embodiment of FIG. 3 and the driving voltage converter 124*a* (see FIG. 10) included in the overheat prevention circuit 120*a* (see FIG. 10) according to the embodiment of FIG. 10. For simplicity, a redundant description will be omitted.

Referring to FIG. 13, the signal controller 100*b* according to the current embodiment includes an image signal conversion unit 110 and the overheat prevention circuit 120*b*.

The image signal conversion unit 110 is substantially the same or similar to that described above in the embodiment of FIG. 3 and thus will not be described here.

The overheat prevention circuit 120*b* includes a detector 121, a comparator 122, the lookup table selector 123, and the driving voltage converter 124*a*.

The detector 121 and the comparator 122 are substantially the same or similar to those described above in the embodiment of FIG. 3 and thus will not be described here.

The lookup table selector 123 receives from the comparator 122 information about whether the number of toggles included in each frame is equal to or greater than a reference number of toggles, selects any one of a plurality of lookup tables LU1 and LUT2 based on the received information, and provides the selected lookup table LUT1 or LUT2 to a data driver 300. The information about the selected lookup table LUT1 or LUT2 provided to the data driver 300 may be a lookup table selection signal LSS. Since other details of the lookup table selector 123 have been described above in the embodiment of FIG. 3, they will not be described here.

The driving voltage converter 124*a* receives from the comparator 122 the information about whether the number of toggles included in each frame is equal to or greater than the reference number of toggles, generates a driving voltage conversion signal VCS, which determines the voltage level of a driving voltage applied by a power supply unit 500*a* to a gray voltage generator 400, based on the received information, and provides the driving voltage conversion signal VCS to the power supply unit 500*a*. Since other details of the driving voltage converter 124*a* have been described above in the embodiment of FIG. 10, they will not be described here.

As described above, when the overheat prevention circuit 120*b* includes both the lookup table selector 123 and the driving voltage converter 124*a*, the overheat prevention effect can be maximized. This issue will be described in more detail by additionally referring to FIG. 14.

Figure 14:
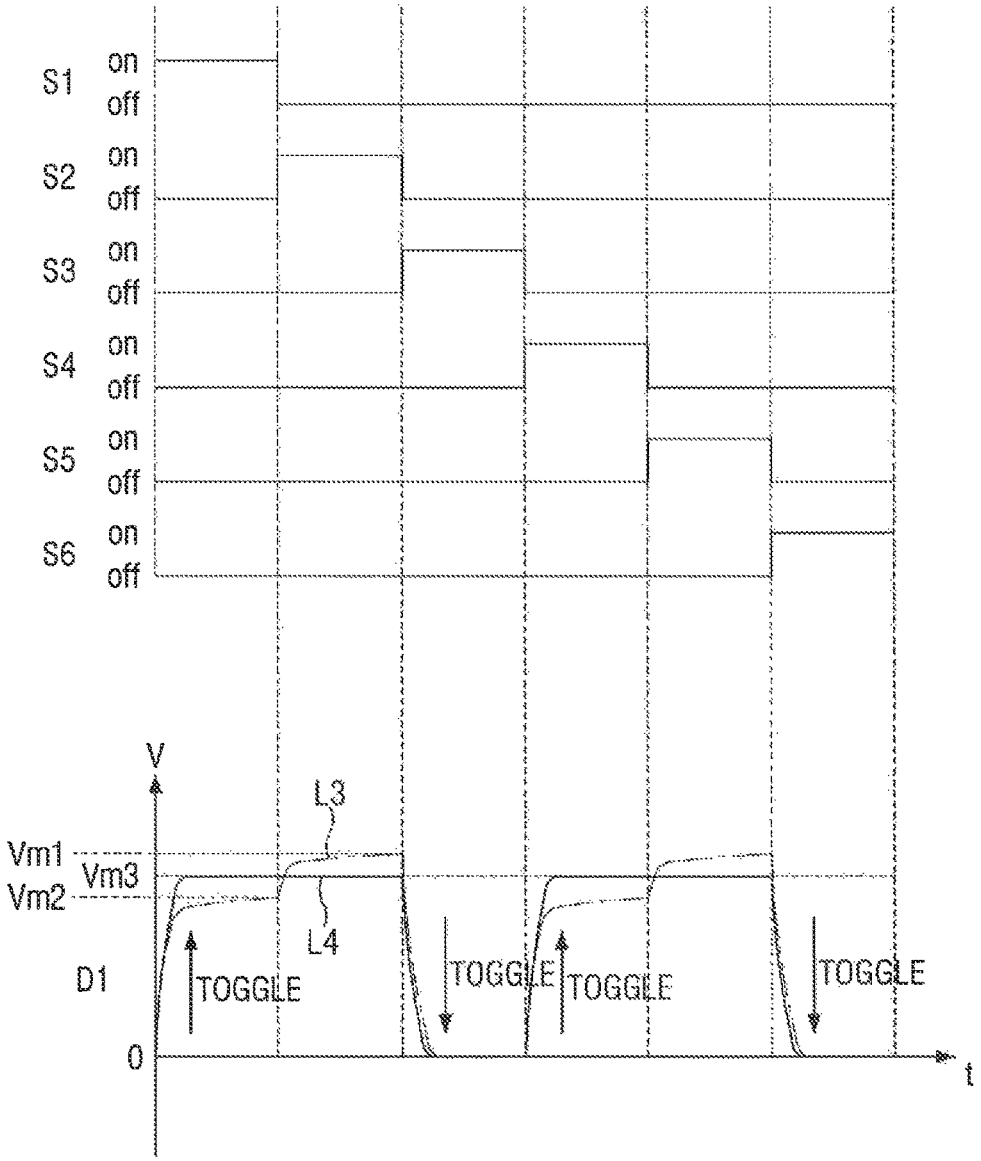
FIG. 14 is a waveform diagram of six pixels corresponding to the pixels of FIG. 4 in a display device according to the embodiment of FIG. 13.

FIG. 14 is a waveform diagram of six pixels corresponding to the pixels of FIG. 4 in a display device according to the embodiment such as shown in FIG. 13.

In FIG. 14, a voltage level represented by a third line L3 is the voltage level of a first data signal D1 in a case where a first driving voltage AVDD1 and value(s) from the first lookup table LUT1 are used, and a voltage level represented by a fourth line L4 is the voltage level of the first data signal D1 in a case where a second driving voltage AVDD2 and value(s) from the second lookup table LUT2 are used. As in the embodiment of FIG. 5, it is assumed in FIG. 14 that each of first through sixth pixels PX1 through PX6 displays cyan.

Referring now to FIG. 14, the first data signal D1 represented by the third line L3 undergoes a voltage change of Vm2 [V] at a time when a first scan signal S1 is turned on, undergoes a voltage change of Vm1-Vm2 [V] at a time when a second scan signal S2 is turned on, and undergoes a voltage change of Vm1 [V] at a time when a third scan signal S3 is turned on. Further, the first data signal D1 represented by the third line L3 undergoes a voltage change of Vm2 [V] at a time when a fourth scan signal S4 is turned on, undergoes a voltage change of Vm1-Vm2 [V] at a time when a fifth scan signal S5 is turned on, and undergoes a voltage change of Vm1 [V] at a time when a sixth scan signal S6 is turned on.

On the other hand, it is also shown that the first data signal D1 represented by the fourth line L4 undergoes a voltage change of Vm3 [V] at the time when the first scan signal S1 is turned on, undergoes no voltage change at the time when the second scan signal S2 is turned on, and undergoes a voltage change of Vm3 [V] at the time when the third scan signal S3 is turned on. Further, the first data signal D2 represented by the fourth line L4 undergoes a voltage change of Vm3 [V] at the time when the fourth scan signal S4 is turned on, undergoes no voltage change at the time when the fifth scan signal S5 is turned on, and undergoes a voltage change of Vm3 [V] at the time when the sixth scan signal S6 is turned on. Here, Vm3 [V] has a value smaller than that of Vm1 [V].

Therefore, since the frequency and magnitude of change in the voltage level of the first data signal D1 represented by the fourth line L4 are all reduced, it can be seen that the heat generated by the data driver 300 is relatively reduced as compared with when the first data signal D1 represented by the third line L3 is transmitted.

Figure 15:
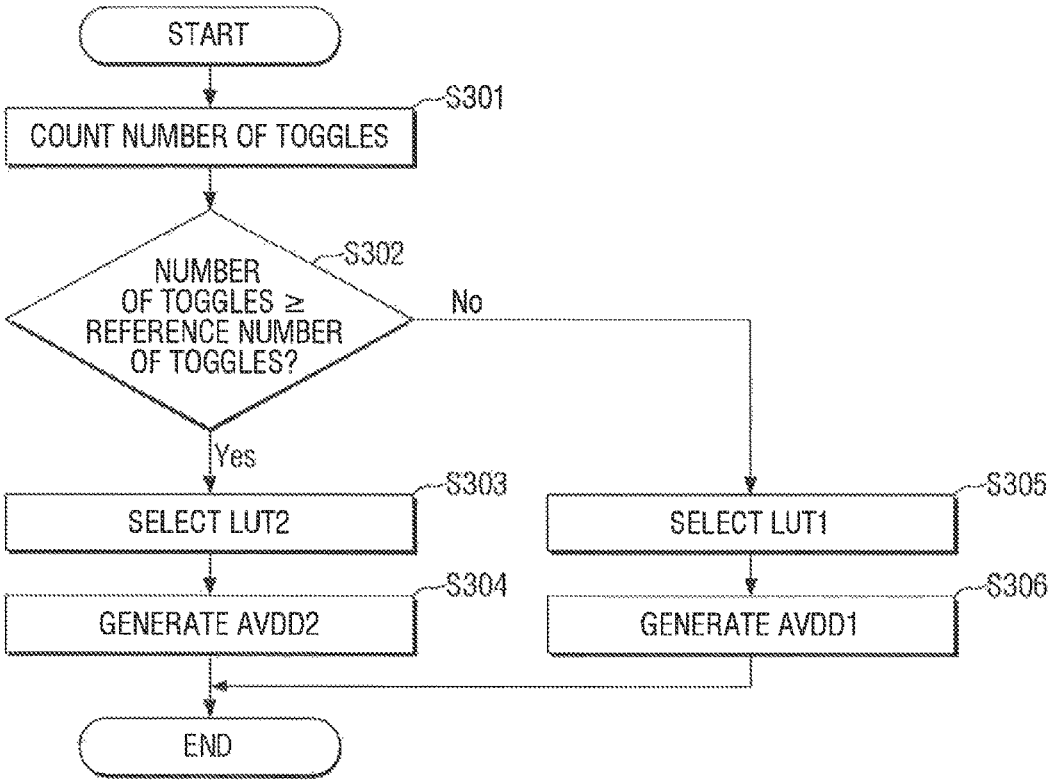
FIG. 15 is a flowchart illustrating the operation of an overheat prevention circuit according to the embodiment of FIG. 13.

FIG. 15 is a flowchart illustrating the operation of the overheat prevention circuit 120*b* according to the embodiment of the inventive concept shown in FIG. 13.

Referring to FIG. 15, at operation (S301) the detector 121 counts the number of toggles included in each frame by using input image data signal DATA.

At operation (S302), the comparator 122 receives information about the number of toggles included in each frame from the detector 121 and determines whether the number of toggles included in each frame is equal to or greater than a reference number of toggles.

When it is determined at operation (S302) that the number of toggles included in each frame is equal to or greater than the reference number of toggles, at operation (S303) the lookup table selector 123 controls the data driver 300 to generate data signals based on the second lookup table LUT2, and at operation (S304) the driving voltage converter 124*a* controls the power supply unit 500*a* to generate the second driving voltage AVDD2.

On the contrary, when it is determined at operation (S302) that the number of toggles included in each frame is not equal to or greater than the reference number of toggles, at operation (S305) the lookup table selector 123 controls the data driver 300 to generate data signals based on the first lookup table LUT1, and at operation (S306) the driving voltage converter 124*a* controls the power supply unit 500*a* to generate the first driving voltage AVDD1.

Figure 16:
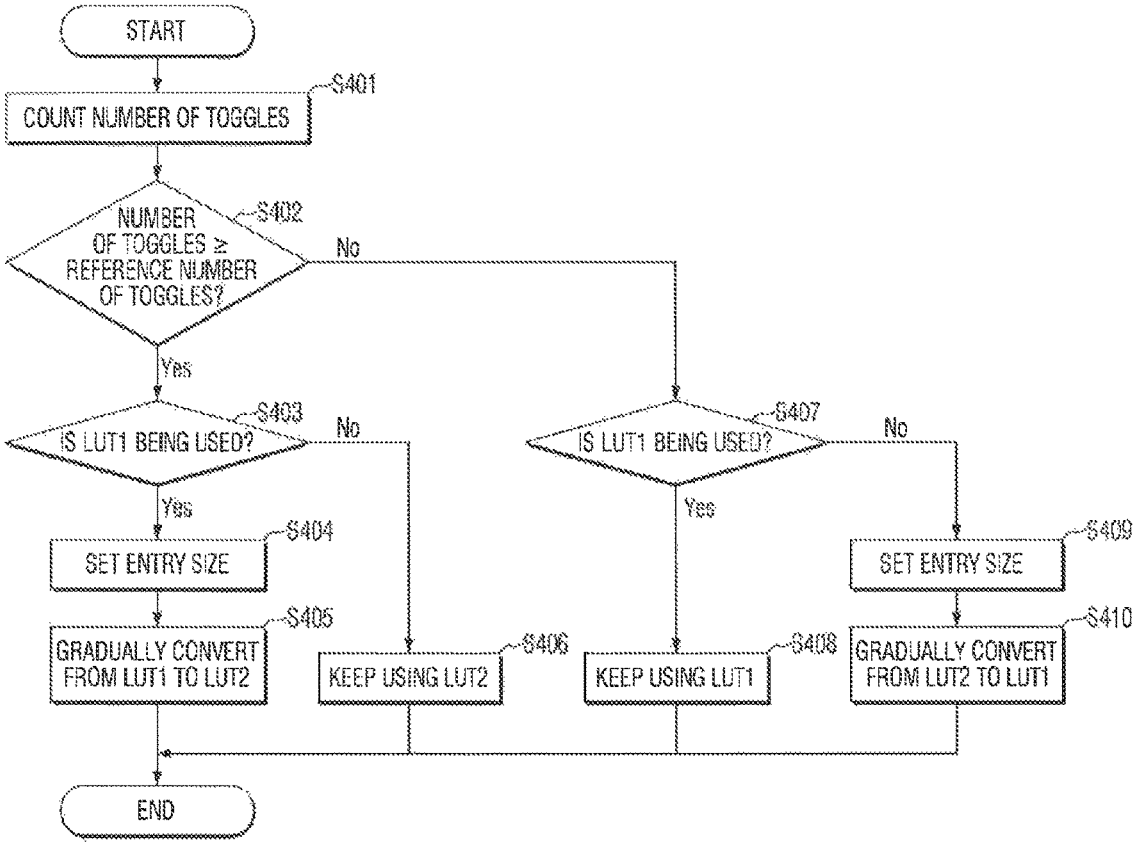
FIG. 16 is a flowchart illustrating the operation of an overheat prevention circuit according to an embodiment of the inventive concept.

FIG. 16 is a flowchart illustrating the operation of an overheat prevention circuit according to an embodiment of the inventive concept.

At operation (S401) a detector 121 (FIG. 10) counts the number of toggles included in each frame by using input image data signal DATA.

At operation (S402), a comparator 122 receives information about the number of toggles included in each frame from the detector 121 and determines whether the number of toggles included in each frame is equal to or greater than a reference number of toggles.

When it is determined at operation (S402) that the number of toggles included in each frame is equal to or greater than the reference number of toggles, it is additionally determined at operation (S403) whether a data driver 300 is currently being driven by a first lookup table LUT1.

If it is determined at operations (S402) and (S403), respectively, that the number of toggles included in each frame is equal to or greater than the reference number of toggles and that the data driver 300 is currently being driven by the first lookup table LUT1, it is determined at operation (S404) whether to control the data driver 300 being driven by the first lookup table LUT1 to be driven by the second lookup table LUT2 according to how many frames in an entry size (e.g. set the entry size). The number of frames corresponding to the entry size may be a predetermined number of frames. However, the number of frames corresponding to the entry size is not limited to the predetermined number of frames and can be variably determined according to the number of toggles.

Once the number of frames corresponding to the entry size is determined at operation (S404), then at operation (S405) the data driver 300 being driven by use of values in the first lookup table LUT1 is gradually changed (e.g. transitioned) to be driven by use of values in the second lookup table LUT2 over a plurality of frames. During the gradual change, a value corresponding to a median value of a value of the first lookup table LUT1 and a value of the second lookup table LUT2 may be used in the frames during the change. Furthermore, the inventive concept is not limited to the above case, and the value of the first lookup table LUT1 can be gradually changed to the value of the second lookup table LUT2 according to the degree of change.

When it is determined at (S402) that the number of toggles included in each frame is equal to or greater than the reference number of toggles and at (S403) that the data driver 300 is currently being driven by the second lookup table LUT2 (e.g. LUT1 is not being used at operation (S403), then at operation (S406) the data driver 300 is continued to be driven using the value(s) of the second lookup table LUT2.

When it is determined at (S402) that the number of toggles included in each frame is less than the reference number of toggles, it is additionally determined (at operation S407) whether the data driver 300 is currently being driven by the first lookup table LUT1.

If at operation (S407) the determination is affirmative (LUT1 is being used, then at operation (S408) the data driver 300 is continued to be driven using value(s) from the first lookup table LUT1 (operation S408).

On the contrary, if at operation (S407) it is determined that the data driver 300 is currently being driven by the second lookup table LUT2 (e.g. the decision at S407 is "no"), it is determined at operation (S409) to set how many frames in the entry size.

At operation (S410), once the number of frames corresponding to the entry size is set, the data driver 300 being driven by using value(s) from the second lookup table LUT2 is gradually changed to be driven by using value(s) from the first lookup table LUT1 over a plurality of frames.

In the current embodiment of the inventive concept, the conversion between the first lookup table LUT1 and the second lookup table LUT2 for driving the data driver 300 is performed not at a time, but gradually. Therefore, a brightness difference caused by the conversion between use of the first lookup table LUT1 and use of the second lookup table LUT2 to drive the data driver 300 results in a gradual change in the display that is not visible (e.g. noticeable) to a user.

Figure 17:
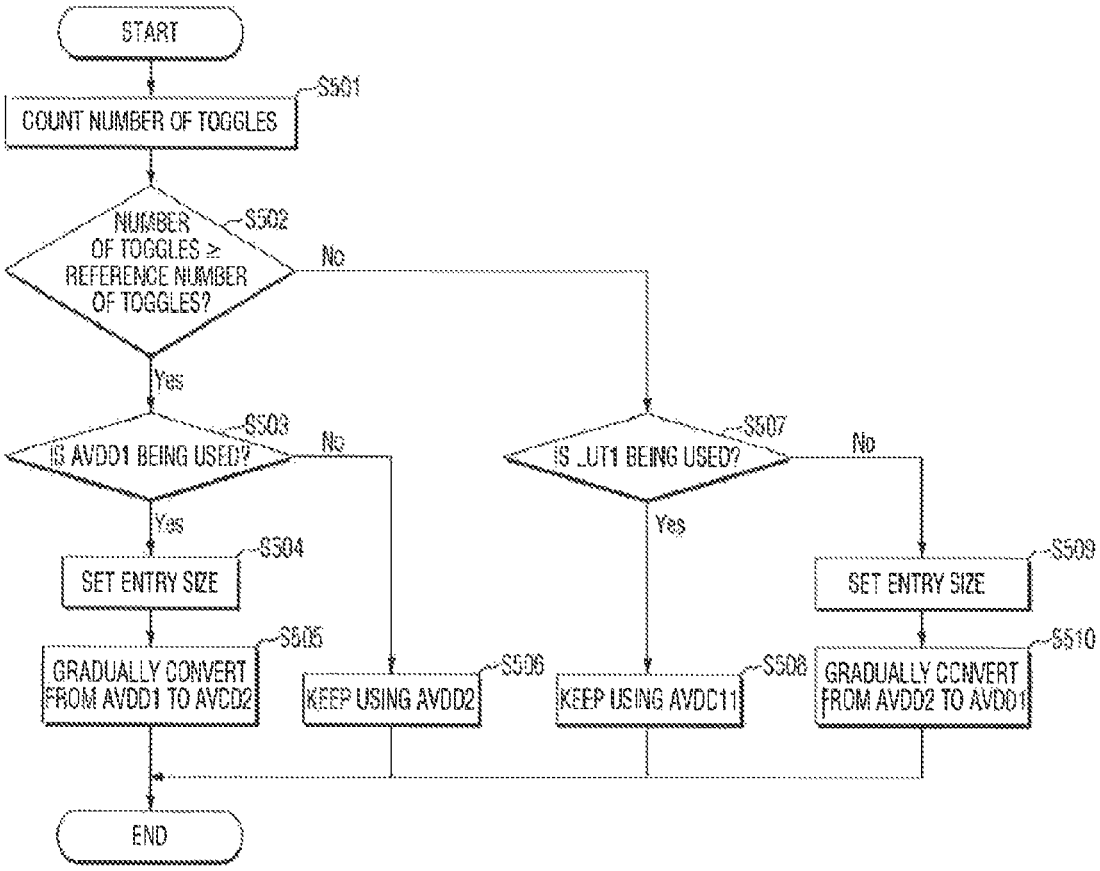
FIG. 17 is a flowchart illustrating the operation of an overheat prevention circuit according to an embodiment of the inventive concept.

FIG. 17 is a flowchart illustrating an example of the operation of an overheat prevention circuit according to an embodiment of the inventive concept.

First, at operation (S501), a detector 121 (e.g. see FIG. 10) counts the number of toggles included in each frame by using input image data signal DATA.

Next, at operation (S502), a comparator 122 (e.g. see FIG. 10) receives information about the number of toggles included in each frame from the detector 121 and determines whether the number of toggles included in each frame is equal to or greater than a reference number of toggles ( ).

When it is determined at operation (S502) that the number of toggles included in each frame is equal to or greater than the reference number of toggles, at operation (S503) it is additionally determined whether a power supply unit 500*a* (e.g., FIG. 10) is currently generating a first driving voltage AVDD1.

If it is determined that the number of toggles included in each frame is equal to or greater than the reference number of toggles (operation S502) and that the power supply unit 500*a* is currently generating the first driving voltage AVDD1 (operation S503), at operation (S504) it is determined whether to control the power supply unit 500*a* currently generating the first driving voltage AVDD1 to generate a second driving voltage AVDD2 according to the quantity of frames in an entry size. The number of frames corresponding to the entry size may be a predetermined number of frames. However, the number of frames corresponding to the entry size is not limited to the predetermined number of frames and can be variably determined according to the number of toggles.

Next, at operation (S505) once the number of frames corresponding to the entry size is determined, the power supply unit 500*a* currently generating the first driving voltage AVDD1 is gradually changed to generate the second driving voltage AVDD2 over a plurality of frames. Thus, a person of ordinary skill in the art should understand and appreciate that the change from the first driving voltage AVDD1 to the second driving voltage AVDD2 is considered a gradual change when it occurs over a plurality of frames. The gradual change may not be noticed, or hardly noticed, by many users. Here, a value corresponding to a median value of the first driving voltage AVDD1 and the second driving voltage AVDD2 may be used in the frames during the change. Furthermore, the inventive concept is not limited to the above case, and the voltage level of the first driving voltage AVDD1 can be gradually changed to the voltage level of the second driving voltage AVDD2 according to the degree of change.

However, when it is determined at operations (S502 and S503) that the number of toggles included in each frame is equal to or greater than the reference number of toggles and that the power supply unit 500*a* is currently generating the second driving voltage AVDD2 (e.g. S503 is a "no"), then at operation (S506) the power supply unit 500*a* keeps generating the second driving voltage AVDD2.

On the other hand, when it is determined at operation (S502) that the number of toggles included in each frame is less than the reference number of toggles, it is additionally determined at operation (S507) whether the first look-up table (LUT 1) is being used, thus determining whether the power supply unit 500*a* is currently generating the first driving voltage AVDD1.

If it is determined from operations (S502) and (S507) that the number of toggles included in each frame is less than the reference number of toggles and that the power supply unit 500*a* is currently generating the first driving voltage AVDD1

(e.g. based on LUT 1 being used), then at operation (S508) the power supply unit 500*a* keeps generating the first driving voltage AVDD1.

On the contrary, if it is determined from operations (S502) and (S507) that the number of toggles included in each frame is less than the reference number of toggles and that the power supply unit 500*a* is currently generating the second driving voltage AVDD2, then at operation (S509) it is determined whether to control the power supply unit 500*a* currently generating the second driving voltage AVDD2 to generate the first driving voltage AVDD1 according to how many frames in the entry size (e.g. set the entry size).

At operation (S510), once the number of frames corresponding to the entry size is determined at operation (S509), the power supply unit 500*a* currently generating the second driving voltage AVDD2 is gradually changed to generate the first driving voltage AVDD1 over a plurality of frames.

In the current embodiment of the inventive concept, the conversion between the generation of the first driving voltage AVDD1 and the generation of the second driving voltage AVDD2 by the power supply unit 500*a* is performed gradually rather than at one time (e.g. change over one frame rather than a plurality of frames. Therefore, a brightness difference caused by the conversion between the first driving voltage AVDD1 and the second driving voltage AVDD2 may not be visible to a user.

According to at least the aforementioned embodiments of the inventive concept discussed herein above, a display device may be constructed so as to prevent overheating of a data driver.

It is also possible to provide a method of driving a display device which can prevent overheating of a data driver.

However, the breadth of the inventive concept is not restricted to the embodiment set forth herein above.

What is claimed is:

1. A display device comprising:

a detector which analyzes image data and detects a number of toggles in which an amount of change in gray values of successive pixels driven by the same data line in one frame is equal to or greater than a reference gray change amount;

a comparator which compares the number of toggles detected by the detector with a reference number of toggles; and a lookup table selector which selects any one of a first lookup table and a second lookup table based on a result of the comparator comparing the number of toggles detected by the detector with the reference number of toggles and provides the selected first lookup table or the second lookup table to a data driver.

2. The display device of claim 1, wherein the detector analyzes the image data in advance of being displayed by the display device, and wherein the first lookup table and the second lookup table include information provided to the data driver that generates respectively different voltage values to display the image data.

3. The display device of claim 2, wherein the data driver operates at respectively different temperatures based on whether the first lookup table or the second lookup table is selected to generate data voltages to display the image data.

4. The display device of claim 1, further comprising a gate line which extends to intersect the data line, wherein long sides of the successive pixels extend parallel to a direction in which the gate line extends.

5. The display device of claim 1, wherein the reference gray change amount comprises a gray change amount by which the gray values of the successive pixels are changed to 90% or more of a maximum gray value.

6. The display device of claim 1, wherein the reference number of toggles is a value obtained by multiplying a total number of pixels by a ratio of the number of toggles occurring when a color is displayed to the number of pixels, and by a maximum allowable proportion of an area occupied by a monochromatic color in one frame.

7. The display device of claim 6, wherein the ratio of the number of toggles to the number of pixels is 2:3.

8. The display device of claim 6, wherein the maximum allowable proportion of the area occupied by the monochromatic color in one frame is 0.7.

9. The display device of claim 1, wherein the first lookup table and the second lookup table provide output gray values converted from input gray values of a first color, a second color, and a third color, wherein an output gray value converted from a maximum gray value of the first color included in the first lookup table is smaller than output gray values converted from maximum gray values of the second color and the third color included in the first lookup table.

10. The display device of claim 9, wherein when the number of toggles detected by the detector is less than the reference number of toggles, the lookup table selector provides the first lookup table to the data driver.

11. The display device of claim 9, wherein an output gray value converted from each gray value which is 90% or more of the maximum gray value of the first color included in the first lookup table is smaller than an output gray value converted from each gray value which is 90% or more of each of the maximum gray values of the second and third colors.

12. The display device of claim 9, wherein output gray values converted from the maximum gray values of the first through third colors included in the second lookup table are the same.

13. The display device of claim 1, further comprising a driving voltage converter which controls the data driver to be driven using any one of a first driving voltage and a second driving voltage based on the comparator comparing the number of toggles detected by the detector with the reference number of toggles.

14. The display device of claim 13, wherein when the number of toggles detected by the detector is less than the reference number of toggles, the driving voltage converter controls the first driving voltage to be output, wherein the first driving voltage has a higher voltage level than the second driving voltage.

15. The display device of claim 13, wherein a conversion between the first driving voltage and the second driving voltage by the driving voltage converter is gradually performed over a plurality of frames.

16. The display device of claim 1, wherein a conversion between the first lookup table and the second lookup table by the lookup table selector is gradually performed over a plurality of frames.

17. A display device comprising:

a detector which detects a number of toggles in which an amount of change in gray values of successive pixels driven by a same data line in one frame is equal to or greater than a reference gray change amount;

a comparator which compares the number of toggles detected by the detector with a reference number of toggles; and a driving voltage converter which controls a data driver to be driven using any one of a first driving voltage and a second driving voltage based on the comparator comparing the number of toggles detected by the detector with the reference number of toggles.

18. The display device of claim 17, further comprising:

a gray voltage generator which provides a reference gray voltage to the data driver; and a power supply unit which provides the first driving voltage or the second driving voltage to the gray voltage generator, wherein the driving voltage converter controls the power supply unit to generate any one of the first and second driving voltages.

19. The display device of claim 17, wherein when the number of toggles is less than the reference number of toggles, the driving voltage converter controls the first driving voltage to be output, wherein the first driving voltage has a higher voltage level than the second driving voltage.

20. A method of driving a display device, the method comprising:

detecting a number of toggles in an image data in which an amount of change in gray values of successive pixels driven by the same data line in one frame is equal to or greater than a reference gray change amount;

determining whether the number of toggles detected is equal to or greater than a reference number of toggles;

selecting a first lookup table when it is determined that the number of toggles is equal to or greater than the reference number of toggles;

selecting a second lookup table when it is determined that the number of toggles detected is less than the reference number of toggles; and providing the selected first lookup table or second lookup table to a data driver.

21. The method of claim 20, wherein the first and second lookup tables provide output gray values converted from input gray values of a first color, a second color, and a third color, wherein an output gray value converted from a maximum gray value of the first color included in the first lookup table is smaller than output gray values converted from maximum gray values of the second color and the third color it in the first lookup table.

22. The method of claim 20, further comprising controlling the data driver to be driven using a first driving voltage based on determining that the number of toggles is equal to or greater than the reference number of toggles, or controlling the data driver to be driven using a second driving voltage when it is determined that the number of toggles is less than the reference number of toggles, wherein the first driving voltage has a higher voltage level than the second driving voltage.

23. The method of claim 22, further comprising selecting the first lookup table or the second lookup table to generate respectively different data voltages to operate the data driver at respectively different temperatures.

* * * * *